US008490837B2

(12) United States Patent
Michaux et al.

(10) Patent No.: US 8,490,837 B2
(45) Date of Patent: Jul. 23, 2013

(54) FLUID MATERIAL DISPENSING HEAD

(75) Inventors: Sebastien Michaux, Caudebec les Elbeuf (FR); Alex Milian, Les Baux de Breteuil (FR)

(73) Assignee: Aptar France SAS, Le Neubourg (FR)

( * ) Notice: Subject to any disclaimer, the term of this patent is extended or adjusted under 35 U.S.C. 154(b) by 128 days.

(21) Appl. No.: 13/256,384

(22) PCT Filed: Mar. 9, 2010

(86) PCT No.: PCT/FR2010/050399
§ 371 (c)(1),
(2), (4) Date: Sep. 13, 2011

(87) PCT Pub. No.: WO2010/103227
PCT Pub. Date: Sep. 16, 2010

(65) Prior Publication Data

US 2012/0024899 A1 Feb. 2, 2012

(30) Foreign Application Priority Data

Mar. 13, 2009 (FR) ..... 09 51589

(51) Int. Cl.
*B67B 1/00* (2006.01)

(52) U.S. Cl.
USPC ..... 222/153.13; 222/321.9; 222/384

(58) Field of Classification Search
USPC ..... 222/153.11, 153.13, 182, 321.8, 222/321.9, 383.1, 384, 402.11
See application file for complete search history.

(56) References Cited

U.S. PATENT DOCUMENTS

| | | | | |
|---|---|---|---|---|
| 7,874,461 | B2 * | 1/2011 | Bae | 222/153.13 |
| 2007/0246484 | A1 * | 10/2007 | Yoshida et al. | 222/153.13 |
| 2008/0023498 | A1 | 1/2008 | Bertin et al. | |
| 2008/0116232 | A1 | 5/2008 | Michaux et al. | |

FOREIGN PATENT DOCUMENTS

| | | | |
|---|---|---|---|
| FR | 2 904 294 | A1 | 2/2008 |
| FR | 2 908 116 | A | 5/2008 |

* cited by examiner

*Primary Examiner* — Kevin P Shaver
*Assistant Examiner* — Daniel R Shearer
(74) *Attorney, Agent, or Firm* — Sughrue Mion, PLLC

(57) ABSTRACT

A fluid dispenser head for mounting on a fluid reservoir so as to constitute a dispenser. The head includes a fluid dispenser member with a body and a valve rod. A dispenser endpiece is rotatably mounted on the valve rod and a turning pusher is manually axially movable so as to move the dispenser endpiece and the valve rod. A transmission part is interposed between the endpiece and the pusher and secured to the pusher in axial movement. An actuator mechanism causes the endpiece and pusher to turn, but not the transmission part. The actuator mechanism moves the transmission part axially between a non-working, storage position and a working, actuation position, in such a manner as to cause the pusher to move axially. The part transmits directly and axially to the endpiece, any thrust force exerted on the pusher in the working position.

13 Claims, 3 Drawing Sheets

FLUID MATERIAL DISPENSING HEAD

CROSS REFERENCE TO RELATED APPLICATION

This application is a National Stage of International Application No. PCT/FR2010/050399 filed Mar. 9, 2010, claiming priority based on French Patent Application No. 09 51589, filed Mar. 13, 2009, the contents of all of which are incorporated herein by reference in their entirety.

The present invention relates to a fluid dispenser head for associating with, or for mounting on, a fluid reservoir. The term "dispenser head" refers herein to the entire unit for mounting on a reservoir in order to constitute a fluid dispenser. By actuating the head, the fluid is taken from the reservoir and dispensed through a dispenser orifice. Such dispenser heads are frequently used in the fields of perfumery, cosmetics, or even pharmacy.

In conventional manner, the dispenser head comprises a fluid dispenser member, such as a pump or a valve. The dispenser member generally comprises a body that is mounted in stationary manner relative to the reservoir, and a valve rod that is axially movable down and up relative to the body. The dispenser head also comprises a pusher that is axially movable down and up, driving the valve rod. In order to expel the fluid, the dispenser head also includes a dispenser orifice that is connected to the valve rod. Thus, by pressing on the pusher by means of one or more fingers, the valve rod is pushed into the body of the dispenser member, thereby dispensing the fluid from the reservoir, optionally in metered manner.

In such a conventional dispenser head, the only possible movement of the pusher is axial movement down and up, imparted by the user who presses by means of one or more fingers on a thrust surface formed by the pusher. Since the pusher is mounted directly on the valve rod, its movement drives the movement of the valve rod directly. In other words, the pusher and the valve rod are moved together, simultaneously.

In the prior art, dispenser heads are also known that are provided with pushers that are movable in turning about their movement axis in order to achieve a locking function for the pusher. Thus, the pusher can be turned between a locked position in which it cannot be moved axially, and an actuatable position that is unlocked and in which the user can press on the pusher and move it axially down and up, so as to dispense the fluid. However, the pusher always remains coupled directly to the valve rod, such that they are constrained to being axially moved together, simultaneously.

In the prior art, document FR 2 904 294 is also known that describes a fluid dispenser head comprising: a pump; a pusher that is provided with a dispenser orifice that is connected to the pump via a flexible hose; and actuator means making it possible to drive the pusher in turning and in axial movement between a low axial position and a high axial position. An internal cam system serves to transform the turning movement of the pusher into an axial movement. Given that the dispenser orifice is secured to the pusher and that the pump is stationary, the axial movement of the pusher necessarily implies plastic deformation of the flexible hose that connects the orifice to the pump. In the prior-art dispenser head, the dispenser orifice thus moves axially with the pusher, not only when the head is actuated, but also when the pusher is turned by means of the actuator means. It has been found empirically that the flexible hose does not always deform as desired: sometimes the flexible hose is deformed in such a manner that it forms a fold or kink, thereby preventing the fluid from flowing therethrough. The flexible hose crucially lacks flexibility and one acceptable solution for mitigating that problem of flexibility is to make the flexible hose by molding. However, molding requires a particular mold and considerably increases the cost price of the dispenser head.

Consequently, the present invention seeks to overcome the problems that are associated mainly with the flexible hose in a dispenser head having a pusher that is driven both in turning and in axial movement. The present invention seeks to eliminate the flexible hose, while preserving the overall design of the dispenser head, including a pusher having both axial and turning movement.

To do this, the present invention proposes a fluid dispenser head for mounting on a fluid reservoir so as to constitute a dispenser, the head comprising: a fluid dispenser member, such as a pump, comprising a body that is mounted in stationary manner relative to the reservoir, and a valve rod that is axially movable down and up; a dispenser endpiece that is rotatably mounted on the valve rod, the endpiece including a dispenser orifice; and a turning pusher that is manually movable axially down and up so as to move the dispenser endpiece and the valve rod, in such a manner as to dispense the fluid; the head being characterized in that it further comprises: a transmission part that is interposed between the endpiece and the pusher, the part being secured to the pusher in axial movement; and actuator means that cause the endpiece and the pusher to turn, without causing the transmission part to turn, the actuator means moving the transmission part axially between a non-working, storage position and a working, actuation position, in such a manner as to cause the pusher to move axially between a low, non-working position and a high, working position, the part transmitting directly and axially to the endpiece, any thrust force exerted on the pusher in the working position. The dispenser head differs from that in the above-mentioned prior-art document in that it does not include a flexible hose connecting the dispenser orifice to the pump. Compared to the prior-art document, the pusher is separate from the dispenser endpiece that includes the dispenser orifice. Thus, the transmission part may be operatively interposed between the pusher and the dispenser endpiece in selective manner, i.e. in the working position. The actuator means of the invention do indeed cause the endpiece and the pusher to turn, but they leave the transmission part stationary, such that there is relative turning between the transmission part and the pusher. It is specifically this relative turning that enables the transmission part to be interposed between the pusher and the endpiece in the working position. The dispenser head of the invention preserves an overall configuration that is substantially similar to the configuration of prior-art document FR 2 904 294: however, the dispenser orifice no longer moves axially with the pusher, given that said pusher is separate from the dispenser endpiece.

In a particular embodiment, the actuator means may comprise: a turning control member that the user can grasp so as to turn it without moving it axially; and cam means so as to transform the turning of the control member into an axial movement without turning the transmission part. Advantageously, the cam means comprise: a guide ring that is mounted in stationary manner relative to the dispenser member, the ring defining at least one cam path that is substantially helical; and a cam cylinder that includes at least one cam pin that is engaged in a respective cam path of the ring, the cylinder being turned by the turning control member in such a manner as to slide axially in said control member. Preferably, the dispenser endpiece is constrained to turn with the cam cylinder while sliding axially inside said cylinder. Preferably, the cylinder includes an axial guide slot in which the endpiece is received and guided in axial sliding. Advantageously, the transmission part is prevented from turning on the guide ring, while enabling it to move axially relative to the ring. Advantageously, the transmission part extends inside the cylinder and around the endpiece. Preferably, the part includes tabs that slide axially into corresponding axial grooves that are formed by the guide ring. Advantageously, the cylinder and the pusher are secured to each other, and co-operate with each other to form a housing in which the transmission part is received to turn freely. In another aspect of the invention, the control member is rotatably mounted on the guide ring. According to another characteristic of the invention, the guide ring locks the dispenser member on the reservoir.

In summary, the control member turns about its own axis on the guide ring that constrains the cylinder and the pusher to move axially, taking with them the transmission part that is nevertheless constrained to move with the guide ring, the dispenser endpiece also being turned by the control member without being moved axially. The result of the relative movements of the component elements is that the pusher moves axially relative to the control member, with the dispenser orifice secured to the control member.

The present invention also defines a fluid dispenser comprising a fluid reservoir and a dispenser head as defined above.

The invention is described more fully below with reference to the accompanying drawings, which show an embodiment of the invention by way of non-limiting example.

Figure 1:
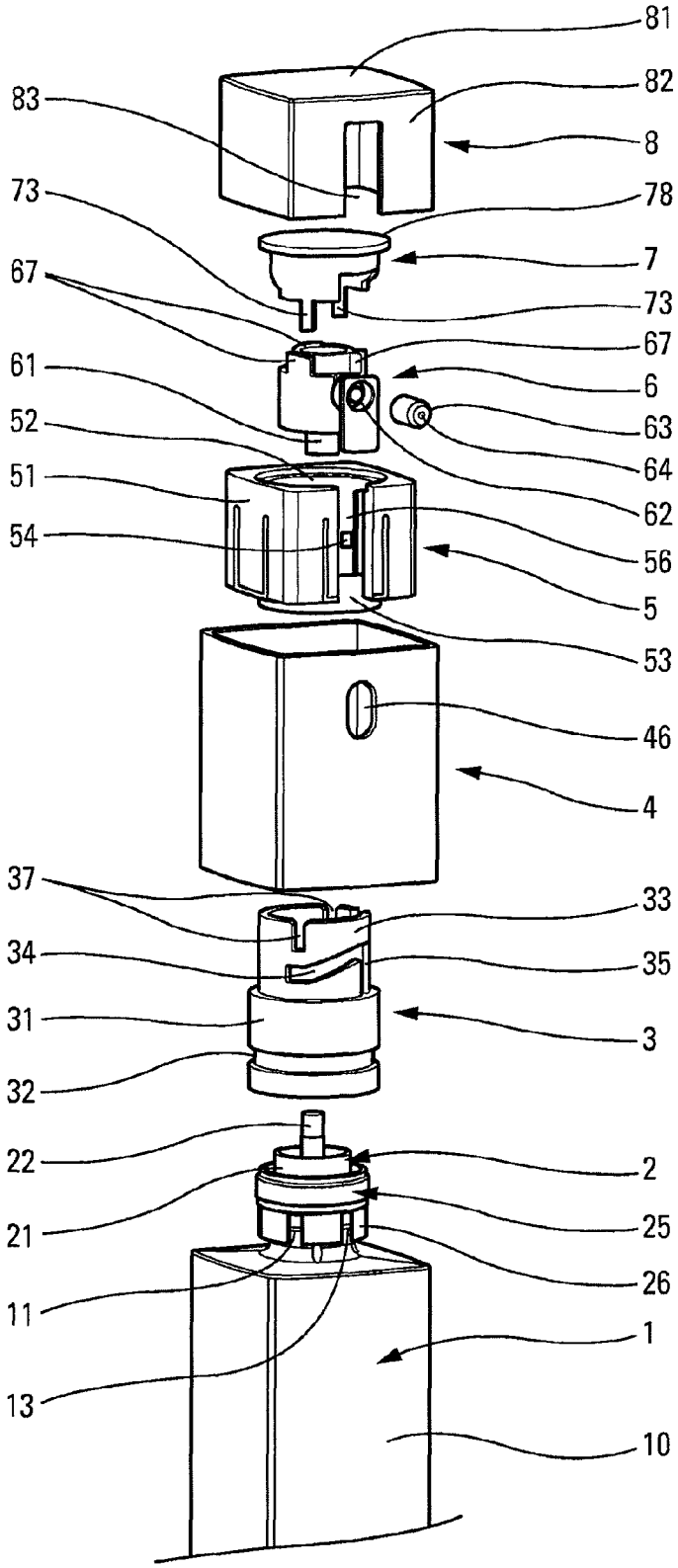
FIG. 1 is an exploded perspective view of a fluid dispenser head in a non-limiting embodiment of the invention.

Reference is made firstly to FIG. 1 in order to explain in detail the structure of the various component elements of the dispenser head of the invention.

The dispenser head is for associating with a fluid reservoir 1 that defines a body 10 and a neck 11. The body 10 defines a working volume that is the volume of the reservoir. The neck 11 defines an opening that puts the inside of the body 10 into communication with the outside. The neck 11 advantageously forms a projecting outer peripheral rim that defines a shoulder 13 that is oriented downwards. The shoulder 13 serves to fasten the dispenser head on the reservoir. In this particular embodiment of the invention, the reservoir defines a section that is polygonal, advantageously square, at the body 10.

In this particular embodiment, the dispenser head comprises seven distinct component elements, namely: a dispenser member 2; a guide ring 3; a turning control member 4; a cam cylinder 5; a dispenser endpiece 6; a transmission part 7; and a pusher 8. All the component elements can be made by injection-molding an appropriate plastics material. Certain component elements can also be made of metal, such as the turning control member 4 or even the pusher 8.

The dispenser member 2 can be a pump or a valve including a body 21 defining a bottom inlet that is optionally provided with a dip tube. The pump or valve also includes an actuator rod 22 that is axially movable down and up inside the body. In conventional manner, the valve rod 22 defines an internal flow duct for the fluid, which flow duct is put into communication with the inside of the body 20 selectively by means of an outlet valve. The pump or valve can also be fitted with a fastener ring 25 that is provided with fastener tabs 26 for coming into engagement below the shoulder 13 of the neck 11. In this embodiment, the fastener ring 25 is presented as a component element of the dispenser member. However, the fastener ring can also be in the form of an element that is distinct from the dispenser member, and that is fastened on the dispenser member. However, in this embodiment, the fastener ring is considered as forming an integral part of the dispenser member. This design is entirely conventional for a pump or a valve in the fields of perfumery, cosmetics, or even pharmacy. By pressing on the valve rod 22, the outlet valve (not shown) opens, and the fluid stored in the body 20 can flow out through the rod 22.

The guide ring 3 is mounted in stationary manner on the dispenser member 2, and preferably in permanent manner. Consequently, the guide ring 3 is stationary both axially and in turning relative to the reservoir 1. The guide ring 3 performs a plurality of distinct technical functions as described below, after the other component elements of the dispenser head have been described. For the moment, the structure of the fastener ring 3 is described. Starting from the bottom of the ring, it can be seen that it firstly includes a bottom section 31 of generally cylindrical shape that is however interrupted at an annular groove 32. The ring 3 also includes a top section 33 that, in this embodiment, presents an outside diameter that is slightly smaller than the outside diameter of the bottom section 31. The top section 33 includes two cam paths 34, one of which is visible in FIG. 1, the other cam path being situated on the other side of the top section 33 in diametrally-opposite manner. The two cam paths 34 are substantially helical, and extend at one end by a vertical axial chimney 35. In addition, the top section 33 includes two axial grooves 37 that, in this embodiment, are disposed in diametrally-opposite manner. The grooves 37 open upwards and open out onto the top annular edge of the top section 33. The grooves 37 thus extend downwards, and each includes a bottom that is situated above the helical cam path 34. The guide ring 3 is hollow inside, and presents an inside diameter at the bottom section 31 that is adapted to clamp radially around the fastener ring 25 of the dispenser member 2. The guide ring 3 may be force-fitted on the fastener ring 25 until the bottom edge of the section 31 comes to bear on the reservoir. By surrounding the fastener ring 25, the bottom section 31 blocks the fastener tabs 26 below the shoulder 13 of the reservoir. It can thus be said that the guide ring 3 also performs a blocking function, making it possible to lock the fastener ring 25 on the neck 11 of the reservoir. The functions of the annular groove 32, the cam paths 34, the vertical axial chimneys 35, and the axial grooves 37 are described below.

Figure 2:
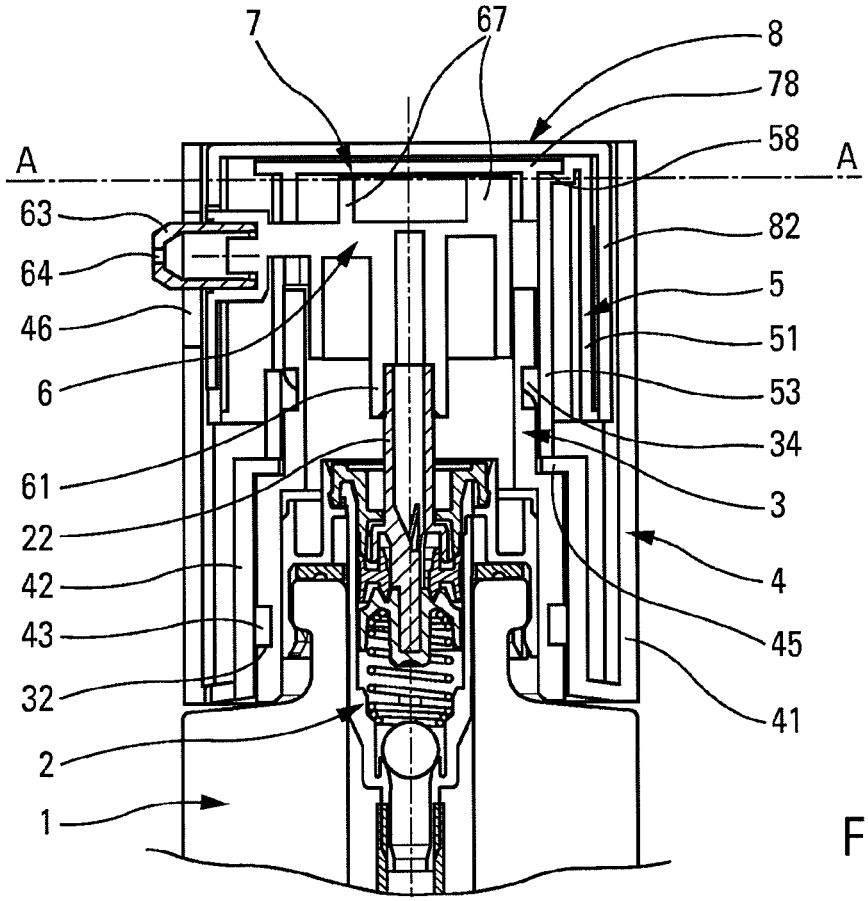
FIG. 2 is a vertical section view through the FIG. 1 dispenser in its assembled state and in its non-working position.
Figure 4:
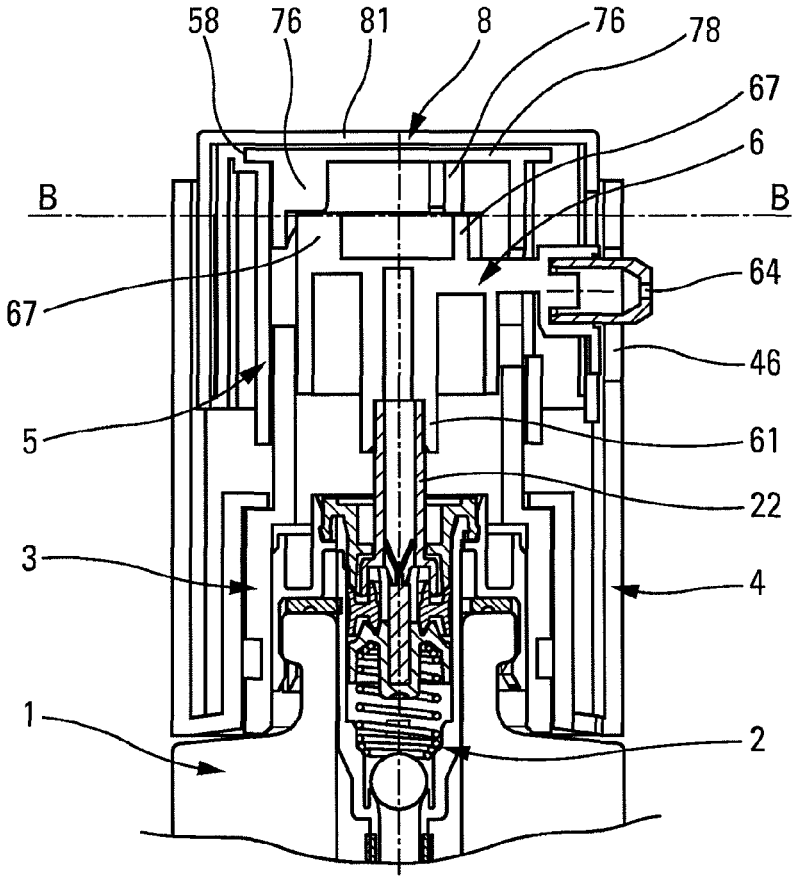
FIG. 4 is a vertical section view through the dispenser in FIGS. 1 and 2, in its working position.

The turning control member 4 presents an external configuration that is substantially parallelepiped having a cross-section that is square, just like the reservoir 1. The control member 4 is a visible part of the dispenser, and thus contributes to its overall attractive appearance. Thus, for appearance, but also practical, purposes, the reservoir 1 and the turning control member 4 present substantially the same cross-section, such that the control member extends upwards in register with the reservoir. Thus, the turning control member includes four faces of substantially equal dimensions, of which one face is provided with an oblong window 46 having an axis that is vertical. With reference to FIGS. 2 and 4, it can be seen that, in reality, the turning control member 4 includes an outer casing 41 of section that is square, and that provides the attractive visual external appearance, and that forms the oblong window 46. The control member 4 also includes a coaxial inner bushing 42 of section that is round, and that is connected to the outer casing 41 at their respective ends. The bushing 42 includes an annular inner rib 43 that is continuous or discontinuous. The rib 43 is designed to be received in the groove 32 of the guide ring 3 in such a manner as to fasten the turning control member 4 on the guide ring 3 while enabling it to turn about its own axis, but without moving axially. At its top end, the bushing 42 defines an inwardly-directed rim 45 that comes to bear against the top edge of the bottom section 31 of the guide ring 3.

The cam cylinder 5 is a part of shape that is complex, including an outer casing 51 of cross-section that is substantially square, and an inner bushing 53 that is substantially circularly cylindrical. The casing 51 and the bushing 53 are connected together at their respective top ends. The bushing 53 thus defines a hollow inside 52 that is substantially cylindrical, and that is provided with two cam pins 54 that are for housing in the cam paths 34 and the chimneys 35 of the guide ring 3. Thus, the cylinder 5 can turn relative to the ring 3 over a certain angle, about 90°, while simultaneously moving axially over a certain distance. The pins 54 are constrained to follow the helical path of the cam paths 34 as far as the chimneys 35 where the pins 54 can be moved axially and vertically without any turning component. In other words, the ring 3 serves as a guide member for the cylinder 5. In addition, the dimension of the outer casing 51 of the cylinder 5 is such that the cylinder 5 may be engaged inside the turning control member 4 without excessive friction. In this way, by turning the control member 4 on the guide ring 3, the cylinder 5 is turned, but it also moves axially relative to the ring 3 and to the member 4, under the effect of the pins 54 that are engaged in the cam paths 34. If consideration is given only to the member 4 and to the cylinder 5, it can be said that the cylinder 5 moves axially inside the member 4 when said member is turned on the ring 3. In addition, the cylinder 5 also forms an axial guide slot 56 that extends both through the outer casing 51 and also through the inner bushing 53. In other words, the slot 56 puts the outside into communication laterally with the inside 52 of the cylinder 5. The cylinder 5 is engaged inside the member 4, in such a manner that the slot 56 is disposed in alignment with the oblong window 46. The inside 52 of the cylinder 5 thus communicates directly with the outside through the window 46 and the slot 56 that are in alignment, and this even when the cylinder 5 slides axially inside the control member 4.

The dispenser endpiece 6 includes a connection sleeve 61 for interfitting on the free end of the actuator rod 22 of the dispenser member 2. The endpiece 6 also includes a housing 62 for receiving a nozzle 63 that forms a dispenser orifice 64 making it possible to dispense fluid in the form of spray. Although not shown, the sleeve 61 communicates with the nozzle 63 by means of an internal fluid feed channel. In addition, the endpiece 6 forms a plurality of lugs 67 that are situated at the top edge of the endpiece 6. In the embodiment used to illustrate the invention, there are three lugs 67 that are uniformly distributed angularly. The endpiece 6 is disposed inside the cylinder 5, with the nozzle disposed in the slot 56 and the window 46, as can be seen in FIGS. 2 and 4. The endpiece 6 is axially movable in the slot 56 and the window 46, taking with it the actuator rod 2 of the dispenser member 2. This is what happens when the dispenser member 2 is actuated. However, when the cylinder 5 moves axially inside the control member 4, the endpiece 6 remains axially static, although it is caused to turn as a result of the nozzle 63 being engaged through the window 56. In other words, the endpiece 6 turns about its own axis without any axial component when the cylinder 5 moves axially inside the control member 4 that is turned about its own axis without any axial component on the guide ring 3 that is mounted in stationary manner on the reservoir.

The transmission part 7 includes an annular disk 78 that forms the top portion of the part. From the disk, a plurality of elements extend downwards between the cylinder 5 and the endpiece 6. Amongst other things, the part 7 forms two axial tabs 73 having free ends that point downwards. The tabs 73 extend between the cylinder 5 and the endpiece 6, and are for engaging in the corresponding axial grooves 37 formed by the ring 3. Thus, the tabs 73 can slide axially into the grooves. Consequently, the part 7 is prevented from turning on the ring 3, while being free to move axially. With reference to FIG. 4, it can be seen that the part 7 also includes a plurality of flanges 76, in this embodiment three in number that are uniformly distributed angularly, and that are disposed vertically and radially below the disk 78. The flanges 76 are for coming to bear against the three lugs 67 of the endpiece 6, as can be seen in FIG. 4 that is explained below. Naturally, as the endpiece 6 turns about its own axis, while the part 7 remains static, the flanges 76 and the lugs 67 come into alignment only in a particular "working" position. Outside of this position, the flanges and the lugs are not in alignment, but, on the contrary, they are disposed beside one another, as can be seen in FIG. 3.

The pusher 8 is also of substantially rectangular block shape with a horizontal cross-section that is square, and that is adapted to be engaged without friction inside the turning control member 4. The pusher 8 includes a top bearing surface 81 on which the user can press by means of a finger, in general the index finger for moving it axially. The pusher 8 also includes a lateral skirt that comprises four faces, of which one 82 is formed with a notch 83 that opens downwards. The notch is disposed on the same side as the oblong window 46 and the slot 56. The nozzle 63 of the endpiece 6 passes through the notch 83. The skirt of the pusher 8 is engaged inside the member 4, but outside the cylinder 5, as can be seen in FIGS. 2 and 4.

Figure 3:
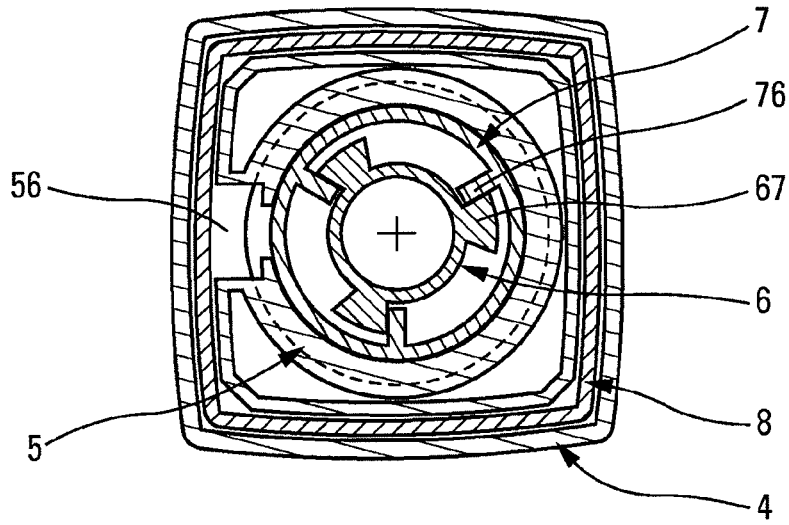
FIG. 3 is a horizontal cross-section view on section line A-A in FIG. 2.

Reference is made below to FIGS. 2 to 4 in order to explain in detail the co-operation between, and the relative movements of, the various component elements of the dispenser head of the invention. With reference firstly to FIG. 2, the head can be seen in a non-working, storage position in which the head cannot be used, with its pusher being blocked in the low position. In this position, the cylinder 5 is in abutment, with its inner bushing 53, against the inwardly-directed rim 45 of the control member 4. This means that the cylinder 5 is in its lowest position. The pins 54 are disposed at the lowest points of the cam paths 34. Naturally, the nozzle 63 is disposed through the slot 56 and the window 46. The transmission part 7 that constitutes a major part of the dispenser head, bears with its disk 78 directly against the lugs 67 of the endpiece 6. In this figure, it should be observed that the outer peripheral edge of the disk 78 is engaged in a housing 58 that is formed between the pusher 8 and the cylinder 5. The disk 78 may turn freely inside the housing 58, but it is constrained to move axially with the pusher 8 and the cylinder 5 that are constrained to move together both axially and in turning. However, although the pusher 8 is secured in axial movement to the part 7, it is not possible, in the non-working, storage position in FIG. 2, to actuate the pusher 8, given that the housing 58 is formed by the cylinder 5 that bears with its bottom end against the control member 4. In other words, the pusher 8 bears directly against the cylinder 5 that bears against the member 4 that is blocked in axial movement. As a result, the pusher 8 cannot be actuated in this low, non-working, storage position.

With reference briefly to FIG. 3, it can be seen that the lugs 67 of the endpiece 6 are situated in the same plane as the flanges 76 of the transmission part 7.

Figure 5:
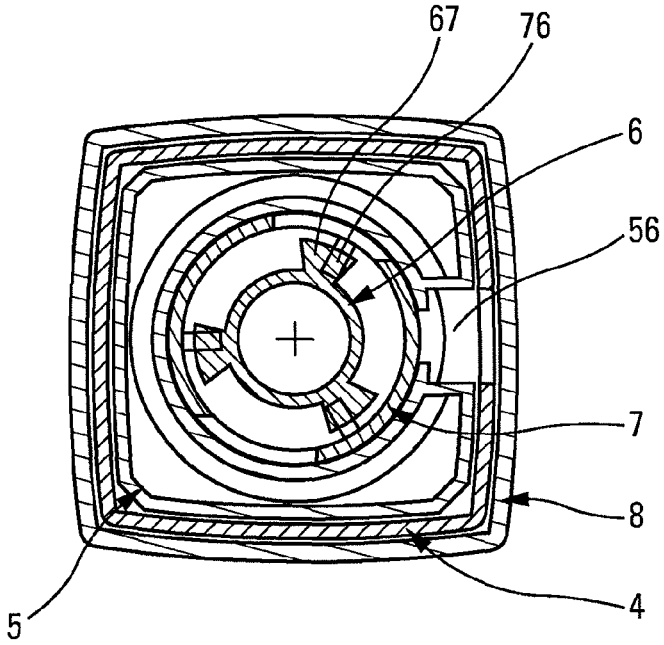
FIG. 5 is a horizontal cross-section view on section line B-B in FIG. 4.

With reference now to FIG. 4, the dispenser head can be seen in the working, actuation position in which it is possible to move the pusher 8 axially down and up, moving the dispenser endpiece 6 and the actuator rod 22. It should be observed that the pusher 8 now projects upwards from the top end of the control member 4. This upward movement was generated by the axial movement of the cylinder 5 that is constrained to follow the cam path 34 when the control member 4 is turned. The pusher is thus fully in its working position. It should be observed that the bottom end of the cylinder 5 is now no longer in abutment against the member 4. The cam pins 54 have followed the cam paths 34 as far as the vertical axial chimneys 35. The dispenser endpiece 6 is in the same axial position, but it has turned through 90°. In particular, it should be observed that the flanges 76 of the transmission part 7 are now positioned above the lugs 67. This can be seen more clearly in FIG. 5. Thus, by pressing on the pusher 8, thrust is now transmitted through the flanges 76 and the lugs 67 to the dispenser endpiece 6 that is moved axially, taking with it the actuator rod 22. In other words, it is the interposing of the flanges 76 between the lugs 67 and the disk 78 that enables the thrust from the pusher to be transmitted to the endpiece 6. This is possible since the part 7 moves only axially, whereas the endpiece 6 and the pusher also move in turning.

In order to understand better the dynamic behavior of the various component elements of the dispenser head, the movement freedoms of each element are listed below:

- dispenser member 2: static in axial and turning movement relative to the reservoir;
- guide ring 3: static in axial and turning movement relative to the reservoir;
- turning control member 4: turnable without axial movement relative to the reservoir;
- cylinder 5: movable in turning and axially relative to the reservoir 1;
- endpiece 6: movable in turning without any axial component (except during actuation) relative to the reservoir;
- part 7: axially movable, without any turning component relative to the reservoir; and
- pusher 8: movable axially and in turning relative to the reservoir 1.

In other words, the dispenser member 2 and the ring 3 are fully secured to each other; the cylinder 5 and the pusher 8 are fully secured to each other; the member 4 turns the cylinder 5 and the pusher 8; the cylinder 5 and the pusher 8 move axially inside the member 4; the part 7 is moved axially by the cylinder 5 and the pusher 8; the part 7 is prevented from turning by the ring 3; the endpiece 6 turns with the pusher 8 and the cylinder 5 without any axial movement, except while it is being actuated.

By means of the dispenser head of the invention, it is possible to move the pusher between a low, non-working, storage position and a high, working, actuation position, without using a flexible hose connecting the dispenser orifice 64 to the actuator rod 22.

The invention claimed is:

1. A fluid dispenser head for mounting on a fluid reservoir so as to constitute a dispenser, the head comprising:

a fluid dispenser member comprising a body that is mounted in stationary manner relative to the reservoir, and a valve rod that is axially movable down and up;

a dispenser endpiece that is rotatably mounted on the valve rod, the endpiece including a dispenser orifice; and a turning pusher that is manually movable axially down and up so as to move the dispenser endpiece and the valve rod, in such a manner as to dispense the fluid;

the head being characterized in that it further comprises:

a transmission part that is interposed between the endpiece and the pusher, the part being secured to the pusher in axial movement; and actuator means that cause the endpiece and the pusher to turn, without causing the transmission part to turn, the actuator means moving the transmission part axially between a non-working, storage position and a working, actuation position, in such a manner as to cause the pusher to move axially between a low, non-working position and a high, working position, the part transmitting directly and axially to the endpiece, any thrust force exerted on the pusher in the working position.

2. A fluid dispenser head according to claim 1, wherein the actuator means comprise:

a turning control member that the user can grasp so as to turn it without moving it axially; and cam means so as to transform the turning of the control member into an axial movement without turning the transmission part.

3. A fluid dispenser head according to claim 2, wherein the cam means comprise:

a guide ring that is mounted in stationary manner relative to the dispenser member, the ring defining at least one cam path that is substantially helical; and a cam cylinder that includes at least one cam pin that is engaged in a cam path of the ring, the cylinder being turned by the turning control member in such a manner as to slide axially in said control member.

4. A fluid dispenser head according to claim 3, wherein the dispenser endpiece is constrained to turn with the cam cylinder while sliding axially inside said cylinder.

5. A fluid dispenser head according to claim 4, wherein the cylinder includes an axial guide slot in which the endpiece is received and guided in axial sliding.

6. A fluid dispenser head according to claim 3, wherein the transmission part is prevented from turning on the guide ring, while enabling it to move axially relative to the ring.

7. A fluid dispenser head according to claim 6, wherein the transmission part extends inside the cylinder and around the endpiece.

8. A fluid dispenser head according to claim 6, wherein the transmission part includes tabs that slide axially into corresponding axial grooves that are formed by the guide ring.

9. A fluid dispenser head according to claim 3, wherein the cylinder and the pusher are secured to each other, and cooperate with each other to form a housing in which the transmission part is received to turn freely.

10. A fluid dispenser head according to claim 3, wherein the control member is rotatably mounted on the guide ring.

11. A fluid dispenser head according to claim 3, wherein the guide ring locks the dispenser member on the reservoir.

12. A fluid dispenser head according to claim 1, wherein the fluid dispenser member is a pump.

13. A fluid dispenser comprising a fluid reservoir and a dispenser head according to any preceding claim mounted on the reservoir.

* * * * *